US007965066B2

(12) United States Patent
Brox

(10) Patent No.: US 7,965,066 B2
(45) Date of Patent: Jun. 21, 2011

(54) VOLTAGE REGULATION SYSTEM

(75) Inventor: Martin Brox, Munich (DE)

(73) Assignee: Qimonda AG, Munich (DE)

( * ) Notice: Subject to any disclaimer, the term of this patent is extended or adjusted under 35 U.S.C. 154(b) by 446 days.

(21) Appl. No.: 10/585,151

(22) PCT Filed: Nov. 23, 2004

(86) PCT No.: PCT/EP2004/053051
§ 371 (c)(1),
(2), (4) Date: Oct. 16, 2007

(87) PCT Pub. No.: WO2005/064426
PCT Pub. Date: Jul. 14, 2005

(65) Prior Publication Data

US 2008/0191790 A1 Aug. 14, 2008

(30) Foreign Application Priority Data

Dec. 30, 2003 (DE) ..... 103 61 724

(51) Int. Cl.
*G05F 1/00* (2006.01)
*G05F 3/16* (2006.01)
*G05F 3/20* (2006.01)

(52) U.S. Cl. ..... 323/266; 323/316; 323/282

(58) Field of Classification Search ..... 323/282, 323/265, 266, 311–316, 243, 299; 327/535–543
See application file for complete search history.

(56) References Cited

U.S. PATENT DOCUMENTS

| | | | | |
|---|---|---|---|---|
| 5,077,518 | A | 12/1991 | Han | |
| 5,132,565 | A | 7/1992 | Kuzumoto | |
| 5,528,548 | A | 6/1996 | Horiguchi et al. | |
| 5,537,073 | A | 7/1996 | Arimoto | |
| 5,731,731 | A * | 3/1998 | Wilcox et al. | 327/403 |
| 5,861,771 | A * | 1/1999 | Matsuda et al. | 327/540 |
| 6,333,623 | B1 * | 12/2001 | Heisley et al. | 323/280 |
| 6,441,594 | B1 * | 8/2002 | Connell et al. | 323/274 |
| 6,774,713 | B2 * | 8/2004 | Watanabe | 327/540 |
| 2002/0030538 | A1 * | 3/2002 | Morishita | 327/541 |

FOREIGN PATENT DOCUMENTS

| | | |
|---|---|---|
| EP | 0600527 | 6/1994 |
| EP | 0822476 | 2/1998 |

* cited by examiner

*Primary Examiner* — Adolf Berhane
*Assistant Examiner* — Emily Pham
(74) *Attorney, Agent, or Firm* — Dicke, Billig & Czaja, PLLC

(57) ABSTRACT

One aspect of the invention relates to a voltage regulation process as well as to a voltage regulation system. A first voltage, present at an input of the voltage regulating system, is changed into a second voltage, which can be tapped at an output of the voltage regulation system, with a first device for generating an essentially constant voltage from the first voltage, or a voltage derived from it. A further device is provided for generating a further voltage from the first voltage or a voltage derived from it, in particular a voltage which can be higher than the voltage generated by the first device.

20 Claims, 4 Drawing Sheets

VOLTAGE REGULATION SYSTEM

CROSS REFERENCE TO RELATED APPLICATION

This Utility Patent Application claims the benefit of the filing date of German Application No. DE 103 61 724.8, Dec. 30, 2003, and International Application No. PCT/DE2004/053051, filed Nov. 23, 2004, both of which are herein incorporated by reference.

BACKGROUND

In semi-conductor components, especially memory components, for instance DRAMs (DRAM=Dynamic Random Access Memory and/or dynamic read/write memory) a voltage level VINT used inside the component can differ from a voltage level used outside the component, e.g., from a voltage level (supply voltage level) VDD, e.g., made available to the semi-conductor component from an external voltage source.

The internally used voltage level VINT can be lower than the level VDD of the supply voltage—for instance the internally used voltage level VINT can amount to 1.5 V and the supply voltage level VDD for instance to between 1.5 V and 2.5 V, etc.

An internal voltage level VINT that has been reduced in relation to the supply voltage level VDD is such that power losses inside the semi-conductor component can be reduced.

In addition, the voltage level VDD of the external voltage supply can be subject to relatively strong fluctuations.

The supply voltage is therefore—in order to allow the component to be operated in a fault-free manner and/or as reliably as possible—usually converted by means of a voltage regulator into an internal voltage VINT (subject to only to relatively minor fluctuations and regulated to a particular constant reduced value).

Conventional voltage regulators (e.g., corresponding down converter regulators) may for instance include a differential amplifier and a p field-effect transistor. The gate of the field-effect transistor can be connected with an output of the differential amplifier, and the source of the field-effect transistor for instance with the external voltage supply.

A reference voltage VREF—subject only to relatively minor fluctuations—is applied to the plus and/or minus input of the differential amplifier. The voltage emitted at the drain of the field effect transistor can be directly back connected with the minus input of the differential amplifier, or with a voltage divider inter-connected.

The differential amplifier regulates the voltage present at the gate connection of the field effect transistor in such a way that the (back-connected) drain voltage—and thereby the voltage emitted by the voltage regulator—remains constant and as high as the reference voltage, or for instance higher by a particular factor.

For generating the above reference voltage VREF, a corresponding conventional reference voltage generator device, for instance a band gap reference voltage generator can be used, which generates—for instance by means of one or more diodes—a signal exhibiting a constant voltage level VBGR from the above supply voltage exhibiting the above relatively high supply voltage level VDD (which may at times be subject be to relatively strong voltage fluctuations).

The signal exhibiting the constant voltage level VBGR can be relayed to a buffer circuit, correspondingly retained (buffered) there and further distributed in the form of corresponding signals exhibiting the above reference voltage level VREF (for instance to the above voltage regulator (and/or to the plus and/or minus input of the corresponding voltage regulator differential amplifier) and/or to further devices, provided on the semi-conductor component, for instance further voltage regulators).

For these and other reasons, there is a need for the present invention.

SUMMARY

One aspect of the invention is aimed at providing a novel voltage regulation system and a novel voltage regulation process. In one embodiment of the invention, a voltage regulation system is made available, with which a first voltage, present at an input of the voltage regulating system, is changed into a second voltage, which can be tapped at an output of the voltage regulation system, with a first device for generating an essentially constant voltage from the first voltage, or a voltage derived from it. A further device is provided for generating a further voltage from the first voltage or a voltage derived from it, in one case a voltage which can be higher than the voltage generated by the first device.

In one embodiment, the voltage generated by the first device, or a voltage derived from it, and the further voltage generated by the further device, or a voltage derived from it, can be used to control a voltage regulation circuit device, in one case, as reference voltage for a voltage regulation circuit device generating the above second voltage.

In one embodiment, an additional device can be provided for activating and/or deactivating the further device.

In one embodiment, if the performance, for example the switching speed of the devices connected with the above (second) voltage, is to be increased the further device can be activated (and thereby it can be achieved that a higher (second) voltage is emitted by the voltage regulation system than during the deactivated state of the further device).

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
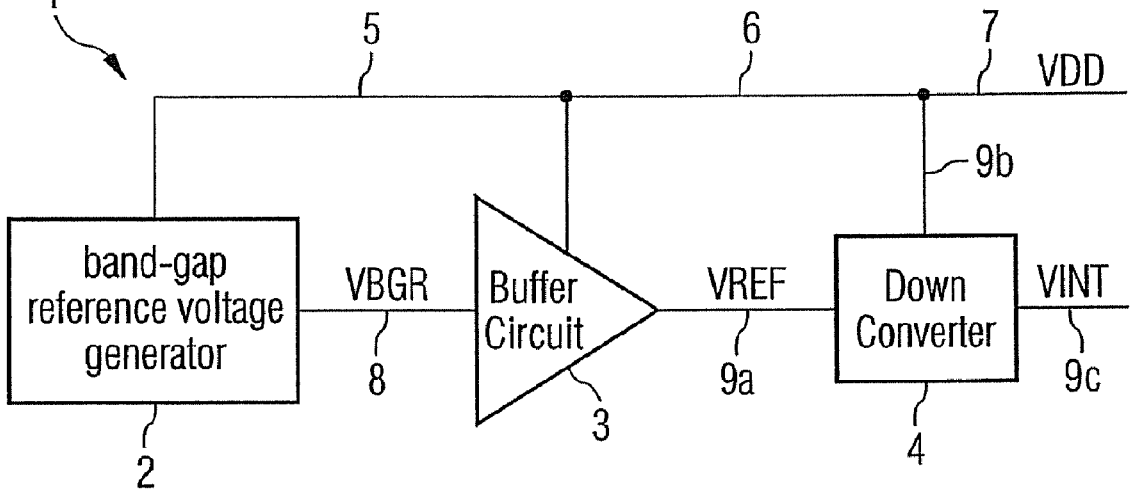
FIG 1 (PRIOR ART)
FIG. 1 illustrates a schematic representation of a conventional voltage regulation system.

FIG. 1 illustrates a schematic representation of a state of the art voltage regulation system 1—arranged on a corresponding semi-conductor component.

This system includes a reference voltage generation device 2 (e.g., a band-gap reference voltage generating device), a buffer circuit 3 and one or more voltage regulators 4 (e.g., corresponding down-converter regulators).

As is apparent from FIG. 1, the reference voltage generation device 2 is supplied—e.g., via corresponding lines 5, 6, 7—with supply voltage made available to the semi-conductor component by the external voltage supply.

The supply voltage exhibits a relatively high voltage level VDD, on occasion subject to relatively strong fluctuations.

The reference voltage generation device 2 generates, for instance by means of one or more diodes, a signal exhibiting a constant voltage level VBGR from the supply voltage.

The signal exhibiting the constant voltage level VBGR is relayed, via a corresponding line 8, to the above buffer circuit 3, where it is correspondingly buffered and distributed (for instance—via a line 9*a*—to the above voltage regulator 4 and/or to further devices provided on the semi-conductor component, for instance further voltage regulators, etc.) in the form of corresponding signals also exhibiting a constant voltage level VREF.

The voltage regulator 4 can for instance include a differential amplifier and a p field-effect transistor. The gate of the field-effect transistor can be connected with an output of the differential amplifier, and the source of the field-effect transistor, via a line 9*b*—with the above external supply voltage (voltage level VDD).

The voltage VREF, which is constant (and/or subject only to relatively minor fluctuations), relayed via the above line 9*a* to the voltage regulator 4, can be applied—as "reference voltage"—to the plus and/or minus input of the differential amplifier.

The voltage emitted at the drain of the field-effect transistor can be directly back-connected, or for instance with a voltage divider inter-connected, with the minus input of the differential amplifier.

The differential amplifier regulates the voltage present at the gate connection of the field-effect transistor in such a way that the (back connected) drain voltage, and thereby also the voltage VINT emitted by the voltage regulator, for instance to a corresponding line 9*c*, is constant and as high as the reference voltage VREF, or for instance higher by a particular factor. With the assistance of the above voltage regulation system 1, a voltage VINT, subject only to relatively minor fluctuations and regulated to a constant reduced value, can thereby be generated from the above external voltage VDD, which is relatively high and subject to relatively major fluctuations; with the assistance of the voltage VINT corresponding devices, provided on the semi-conductor component, can be operated reliably and with only minor power losses.

Figure 2:
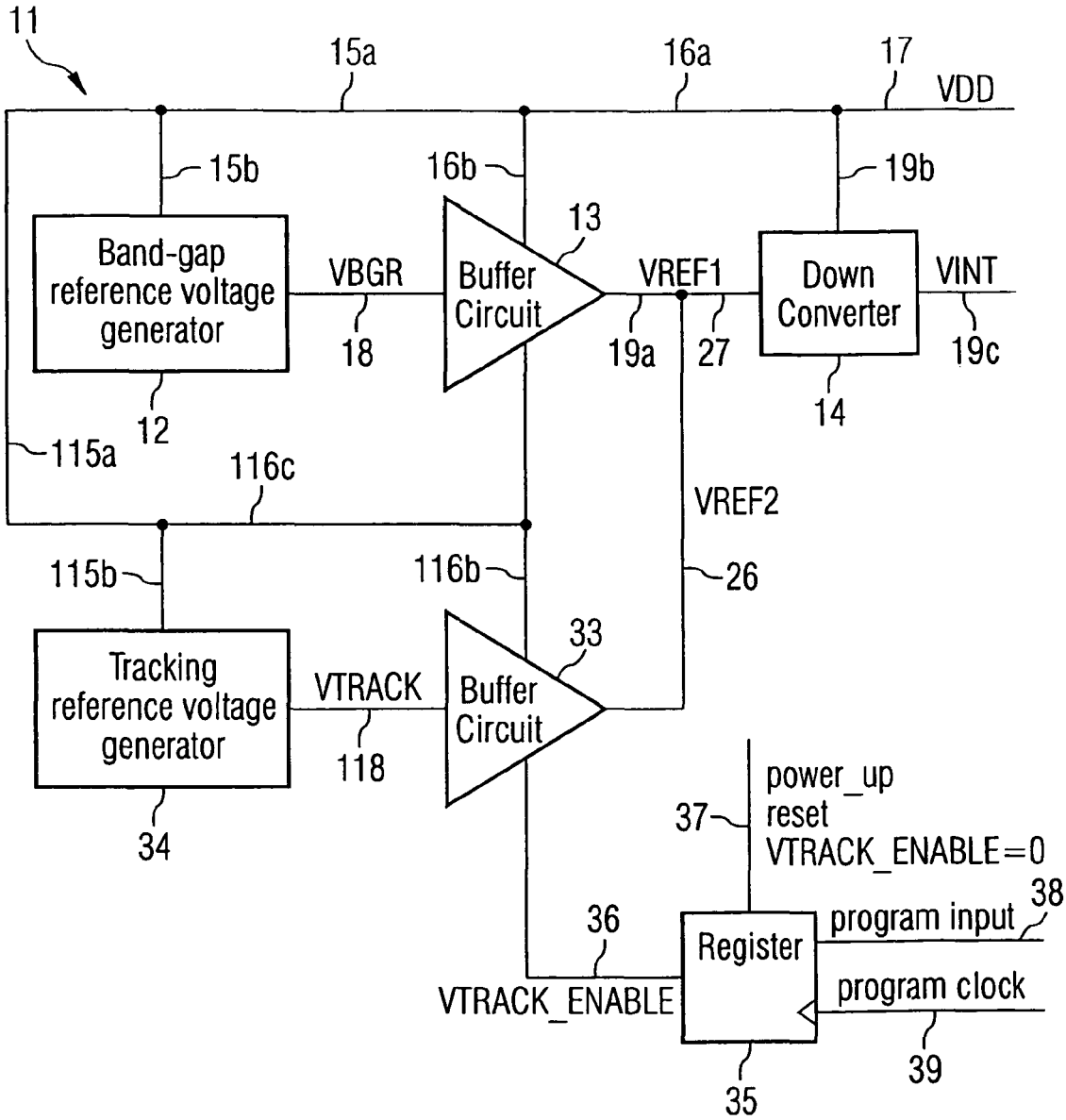
FIG. 2 illustrates a schematic representation of a voltage regulation system in terms of an embodiment example of the invention.

FIG. 2 illustrates a schematic representation of a voltage regulation system 11 according to an embodiment example of the invention arranged on a corresponding semi-conductor.

The semi-conductor component can for instance be a corresponding integrated (analog or digital) computing circuit and/or a semi-conductor memory component such as for instance a function memory component (PLA, PAL etc.) and or a table memory component (e.g., a ROM or RAM), in particular a SRAM or DRAM.

The voltage regulation system 11 includes a reference voltage generation device 12 (for instance a band-gap reference voltage generation device), a buffer circuit 13 and one or more voltage regulators 14 (e.g., corresponding down-converter regulators).

As is apparent from FIG. 2, a supply voltage, made available for the semi-conductor component from an external voltage supply, is fed, for instance via corresponding lines 15*a*, 15*b*, 16*a*, 17, to the reference voltage generation device 12.

The supply voltage exhibits a relatively high voltage level VDD, on occasion subject to relatively major fluctuations. The level of the supply voltage can for instance lie between 1.5 V and 2.5 V, for instance between 1.6 V and 2.0 V (1.8 V±0.2 V).

From the supply voltage the reference voltage generation device 12 generates, for instance by means of one or more diodes, a signal exhibiting a constant voltage level VBGR.

The signal including the constant voltage level VBGR is relayed via a corresponding line 18 to the above buffer circuit 13, correspondingly buffered there and distributed in the form of signals also exhibiting a constant voltage level VREF1 (for instance via a line 19*a* to the above voltage regulator 14 and/or, for instance via other corresponding lines not shown here, to further devices provided on the semi-conductor component, for instance further voltage regulators, etc.).

Figure 3:
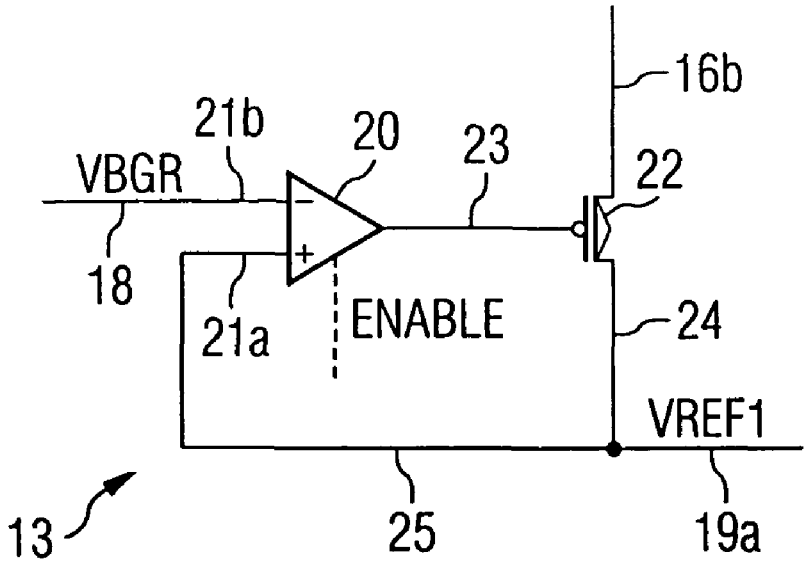
FIG. 3 illustrates a schematic detail representation of a buffer circuit able to be used in the voltage regulation system shown in FIG. 2.

FIG. 3 illustrates a schematic detail representation of a buffer circuit 13 capable of being used in the voltage regulation system 11 shown in FIG. 2.

The buffer circuit 13 includes a differential amplifier 20 with a plus input 21*a* and a minus input 21*b*, and a field-effect transistor 22 (here a p channel MOSFET).

An output of the differential amplifier 20 is connected via a line 23 with a gate connection of the field-effect transistor 22.

As is further shown in FIG. 3, the source of the field-effect transistor 22 is connected with the supply voltage exhibiting the above relatively high voltage level VDD—via a line 16*b* (which, as shown in FIG. 2, is connected with the above lines 16*a*, 17).

As is shown in FIG. 3, the above signal, relayed via line 18 from the reference voltage generation device 12 and exhibiting the above relatively constant voltage level VBGR is present at the minus input 21*b* of the differential amplifier 20.

The signal emitted at the drain of the field-effect transistor 22 and exhibiting the above relatively constant voltage level VREF1, is back-connected with the plus input 21*a* of the differential amplifier 20 via a line 24 and a line 25 connected with it, and via line 19*a* connected with line 24 further distributed to the above voltage regulator 14 (and/or for instance, via corresponding other lines, not shown here, to the above further voltage regulators, etc.).

Figure 4:
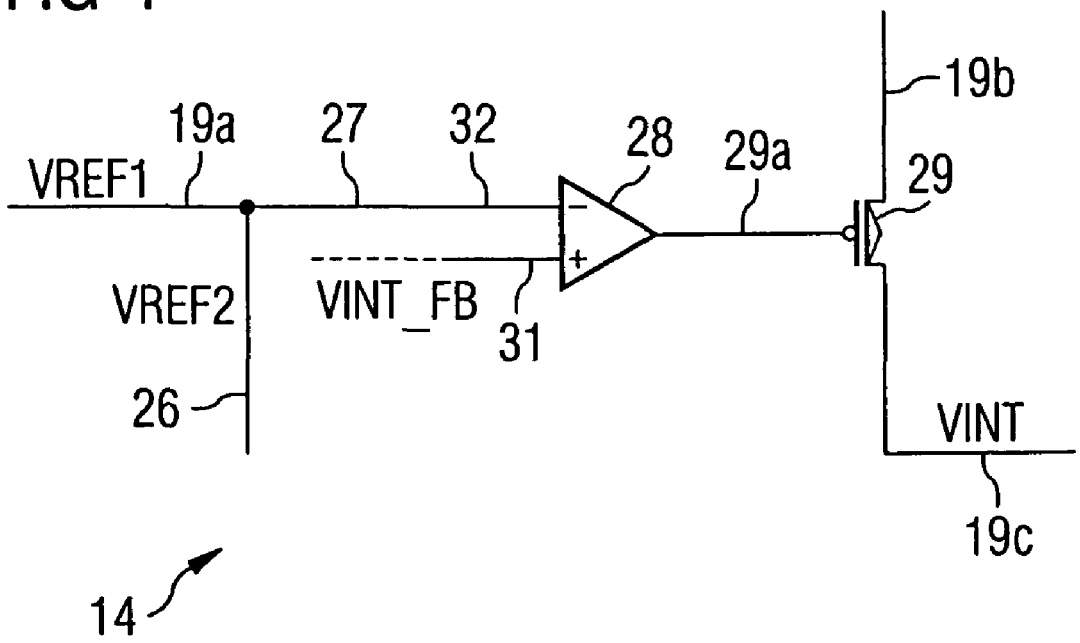
FIG. 4 illustrates a schematic detail representation of a voltage regulator able to be used in the voltage regulation system shown in FIG. 2.

FIG. 4 shows a schematic detail representation of a voltage regulator 14, capable of being used in the voltage regulation system 11 shown in FIG. 2.

The voltage regulator 14 includes a differential amplifier 28 with a plus input 32 and a minus input 31 and a field-effect transistor 29 (here: a p channel MOSFET).

An output of the differential amplifier 28 is connected with a gate connection of the field-effect transistor 29 via a line 29*a*.

As is further shown in FIG. 4, the source of the field-effect transistor 29 is connected via a line 19*b* (and in terms of FIG. 2 via the line 17 connected with it) with the above supply voltage exhibiting the above relatively high voltage level VDD.

As more closely described below, the above (reference) signal exhibiting the relatively constant voltage level VREF1 and fed from the buffer circuit 13 via the line 19*a* and a line 27 connected with it is present at the plus input 32 of the differential amplifier 28, as is additionally on occasion a (further) (reference) signal made available by a further buffer circuit 33 connected in parallel with the above buffer circuit 13 (which signal exhibits, as more closely described below, a variable and/or generally relatively high voltage level VREF2, on occasion subject to corresponding fluctuations, and which is relayed via a line 26, and the line 27 connected with it, from the further buffer circuit 33 to the voltage regulator 14).

The voltage (VINT) emitted at the drain of the field-effect transistor 29 is, in a first embodiment of the voltage regulator 14, directly back-connected with the differential amplifier 28. To this end, the drain of the field-effect transistor 29 can be (directly) connected via a line 19*c* (and a line not shown here connected with it) with the minus input 31 of the differential amplifier 28 (the back-connected voltage (VINT_FB) present at the minus input 31 of the differential amplifier 28, is then as high as the drain voltage (VINT)).

In a second alternative embodiment in contrast, the voltage (VINT) emitted at the drain of the field-effect transistor 29 is back connected with the differential amplifier 28, with the inter-connection of a voltage divider (not shown here), i.e. in subdivided fashion. To this end the drain of the field-effect transistor 29 can be connected via a line 19*c* (and a line not shown here connected with it) with a first resistor $R_2$ (not shown here) of the voltage divider, which, on the one hand is connected to ground (via a further resistance $R_1$ (also not shown here) of the voltage divider), and on the other with the minus input 31 of the differential amplifier 28 (the back connected voltage (VINT_FB), present at the minus input 31 of the differential amplifier 28, will then be smaller than the drain voltage (VINT) by a particular factor).

In the above first embodiment of the voltage regulator 14 (with the direct back-connection of the drain voltage (VINT)), the differential amplifier 28 regulates the voltage present at the gate connection of the field-effect transistor 29 in such a way that the (back-connected) drain voltage (VINT) is as high as the reference voltage present at the plus input 32 of the differential amplifier 28 (i.e., VREF1 (where VREF1 is higher than VREF2) and/or VREF2 (where VREF2 is higher than VREF1)—see below).

In contrast to this, in the second alternative embodiment of the voltage regulator 14 described above in which the drain voltage (VINT) is not directly back-connected, but by means of the above voltage divider—the voltage present at the gate connection of the field-effect transistor 29 of the differential amplifier 28 is regulated in such a way, that the following applies:

$$VINT=VREF\times(1+(R_2/R_1))$$

(or more accurately expressed and as is more closely described below: $VINT=VREF1\times(1+(R_2/R_1))$ where the following applies: VREF1>VREF2 and/or $VINT=VREF2\times(1+(R_2/R_1))$ where the following applies: VREF2>VREF1).

The voltage (VINT) emitted at the drain of the field-effect transistor 29 (i.e., by the voltage regulator 14) onto line 19*c* represents the output voltage of the voltage regulation system 11.

By means of the above regulation, it can be achieved that the output voltage (VINT) of the voltage regulation system 1, as is for instance illustrated in FIG. 5, in contrast to the supply voltage (VDD), which may be partly subject to relatively strong fluctuations, exhibits a constant value VINTnom, for instance 1.5 V (however only when, as is more closely described below, the (further) buffer circuit 33 is not activated (as partly shown in FIG. 5 by means of a broken line) or when, with the buffer circuit 33 in an activated state, the supply voltage (VDD) is (as also more closely described below) lower than a predetermined critical value (VDDnom)).

The output voltage VINT present on line 19*c* can be relayed as "internal supply voltage," if required via further lines not shown here, to corresponding devices provided on the semiconductor component (which devices can thereby be operated, in the case of an output voltage VINT at the above constant voltage level VINTnom, with a high degree of reliability, only relatively low power losses and a relatively long working life).

In one embodiment, if the performance, in particular the switching speed of the devices connected with the output voltage VINT (for instance via line 19*c*), is to be increased, although the reliability and/or working life of the devices operated with the output voltage VINT may thereby on occasion be reduced and/or their power losses increased, the level of the output voltage VINT on line 19*c*, i.e., the level of the internal supply voltage, can be increased above the above-mentioned value ("nominal value" VINTnom) provided for normal use and laid down in the respective specification.

This (further, second) operating method ("high performance operation") can then for instance be employed where the semi-conductor component is to be used in high-end graphics systems, for instance as a high-end graphics memory component, for instance as a memory component, in particular a DRAM memory element for a high clock speed, for example an overclocked processor, in particular a graphics processor.

In order to enable the above "high performance operation", the voltage regulating system 11 is equipped, in addition to the above reference voltage generation device 12 and the buffer circuit 13, with the further buffer circuit 33 already mentioned above, in addition to, as is more closely described below, a (further) reference voltage generation device 34 (e.g., a voltage tracking reference voltage generation device), and an (additional) register 35.

Immediately after the voltage regulation system is put into operation (and/or switched on or "powered up") and/or immediately after the—initial—supplying the above external supply voltage (which, as previously described, is at the above occasionally fluctuating voltage level VDD) to line 17, the voltage regulation system 11 is initially operated in the above "normal operation".

During "normal operation" the above further buffer circuit 33 is deactivated.

Figure 6:
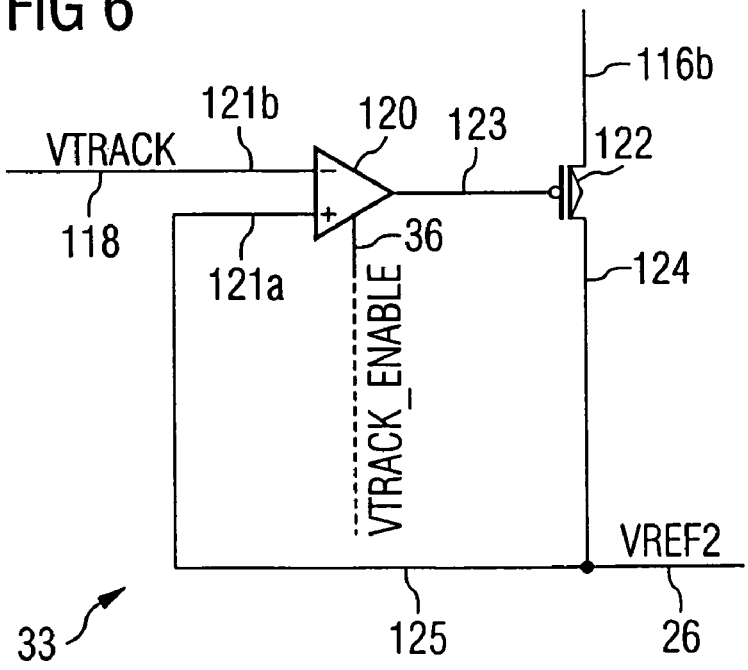
FIG. 6 illustrates a schematic detail representation of a further additional buffer circuit, able to be used in the voltage regulation system shown in FIG. 2.

To achieve this, a corresponding output signal (for instance a "low logic" signal) VTRACK_ENABLE is emitted at a corresponding output of the above register 35 and relayed via a corresponding control line 36 to a corresponding control connection of the buffer circuit 33 (cf. also FIG. 6).

The output of a corresponding (for instance a "low logic") output signal at the above register output when switching on/powering up the voltage regulation system 11, (which initially leads to a deactivated state of the buffer circuit 33) can for instance be ensured thereby that the register is correspondingly reset by means of applying a corresponding reset signal to a line 37, connected with the reset input of register 36 when switching on/powering up the voltage regulating system 11.

If, as it can be individually determined by the respective user of the semi-conductor component, a switch is to be made from the above "normal" operation to the above "high performance" operation while operating the semi-conductor component (and—if necessary repeatedly—back to "normal operation"), an appropriate control signal (for instance a "high logic" control signal for switching to "high performance" operation, and a "low logic" control signal (normal operation activation signal) for switching (back) to "normal operation") from an external control device, connected with the semi-conductor component via corresponding external lines, is applied to line 38 connected with the setting input of the register 35.

At the next positive (or negative) flank of a clock signal made available via a clock line 39 to the clock input of register 35 (for example made available by the above (system) control device) the output signal emitted at the register output (i.e., the signal VTRACK_ENABLE at the control line 36) adopts the state of the control signal present at the setting input of the register 35 (i.e., at line 38), whereby the buffer circuit 33 is either correspondingly activated (a "high logic" state of the VTRACK_ENABLE signal) or again deactivated (a "low logic" state of the signal VTRACK_ENABLE).

FIG. 6 illustrates a schematic detail representation of a buffer circuit (which, as illustrated, is connected with the register 35 via line 36), able to be used as a further additional buffer circuit 33 in the voltage regulation system 11.

The buffer circuit 33 includes a differential amplifier 120 with a plus input 121*a* and a minus input 121*b* and a field-effect transistor 122 (here: a p-channel MOSFET).

An output of the differential amplifier 120 is connected with a gate connection of the field-effect transistor 122 via a line 123.

As is further shown in FIG. 6, the source of the field-effect transistor 122 is connected via a line 116*b* (which in terms of FIG. 2 is connected with the above lines 15*a*, 16*a* and 17 via a line 116*c* and a line 115*a*) with the supply voltage exhibiting the above, relatively high voltage level VDD.

As is apparent from FIGS. 2 and 6, there is a signal relayed via a line 118 from the reference voltage generation device 34 exhibiting a variable and/or correspondingly fluctuating voltage level VTRACK (as is more closely described below) present at the minus input 121*b* of the differential amplifier 120.

The signal emitted at the drain of the field effect transistor 122 and exhibiting the occasionally variable voltage level VREF2 is back-connected via a line 124 and a line 125 connected with it, with the plus input 121*a* of the differential amplifier 120, and emitted onto line 26, which is connected with line 124.

With the help of the further buffer circuit 33, when the buffer circuit 33 is in an "activated" state (i.e., when a "high logic" signal VTRAC_ENABLE is present on the control line 36), the above signal, exhibiting a variable voltage level VTRACK and relayed from the reference voltage generation device 34 via line 118 to the buffer circuit 33, is buffered and relayed, in the shape of signals exhibiting a voltage level VREF2 corresponding with the voltage level VTRACK and able to be tapped at line 26, to the above voltage regulator 14 (and/or for instance via corresponding further lines not shown here to the above further voltage regulators, etc.).

In a "deactivated" state of the buffer circuit 33, however i.e., when a "low logic" signal VTRACK_ENABLE is present on line 36, the output of the buffer circuit 33 (i.e., the drain of the field-effect transistor 122 and thereby also the line 26) is in a highly resistive state.

As is apparent from FIG. 2, the reference voltage generation device 34 ("tracking reference voltage generator") is connected via a line 115*b* and the lines 115*a*, 15*a*, 16*a*, 17 connected therewith with the above supply voltage exhibiting the above relatively high voltage level VDD.

From the supply voltage exhibiting the voltage level VDD, the (further) reference voltage generation device 34 generates a voltage, relayed to the buffer circuit 33 via the line 118 at the voltage VTRACK, which can be higher than the level VBGR of the voltage VBGR generated by the (first) reference voltage generation device 12 (which has the effect that the level VREF2 of the voltage relayed from the (further) buffer circuit 33 to the voltage regulator 14 via line 26 can be higher than the level VREF1 of the voltage relayed from the (first) buffer circuit 13 to the voltage regulator 14 via the line 19*a*).

For instance, a voltage relayed to the buffer circuit 33 via line 118 exhibiting a voltage level VTRACK, which is proportional to the voltage level VDD of the supply voltage, can be generated by the (further) reference voltage generation device 34 from the supply voltage exhibiting the voltage level VDD.

In an alternative embodiment example, the level VTRACK of the voltage generated from the (further) reference voltage generation device 34 will be essentially equal to and/or only slightly lower than the level VDD of the supply voltage (the following can for instance apply: VTRACK=0.5 . . . 0.95× VDD, in particular 0.7 . . . 0.9×VDD, etc.).

For instance, the (further) reference voltage generation device 34 can be arranged in the shape of a voltage divider circuit, including a plurality of resistors connected in series (whereby a first resistor can for instance via line 115*b* be connected with the supply voltage, and a second resistor, in series with the first resistor, with ground potential, whereby the voltage emitted by the (further) reference voltage generation device 34 can be tapped between the two resistors and relayed via line 118 to the buffer circuit 33).

The (further) reference voltage generation device 34 (and the first reference voltage generation device 12) is/are arranged in such a way, that when the supply voltage (VDD) is as high as the above predetermined critical value (VDD-nom), the level VTRACK, generated by the (further) reference voltage generation device 34, is as high as the level VBGR of the voltage generated by the (first) reference voltage generation device 12 (see also FIG. 5), the level VREF1 of the voltage generated by the buffer circuit 13 is then identical with the level VREF2 of the voltage generated by the buffer circuit 33).

In the deactivated state of the (further) buffer circuit 33, the state of the signal input into the voltage regulator 14 at line 27 (and thereby also the state of the signal VINT emitted by the voltage regulator 14 onto line 19*c*) is exclusively determined (due to the highly resistive state of the output of the buffer circuit 33, i.e. of the signal VREF2 present on line 26 at that time) by the signal VREF1 present on line 19*a* connected with line 27 and emitted by the (first) buffer circuit 33; (then, as shown in FIG. 5 by a partly broken line, the level of the signal VINT emitted by the voltage regulator 14, corresponding with the level of the signal VREF1, is constantly at the same level (VINTnom), regardless of the momentary height of the level VDD of the supply voltage).

Figure 5:
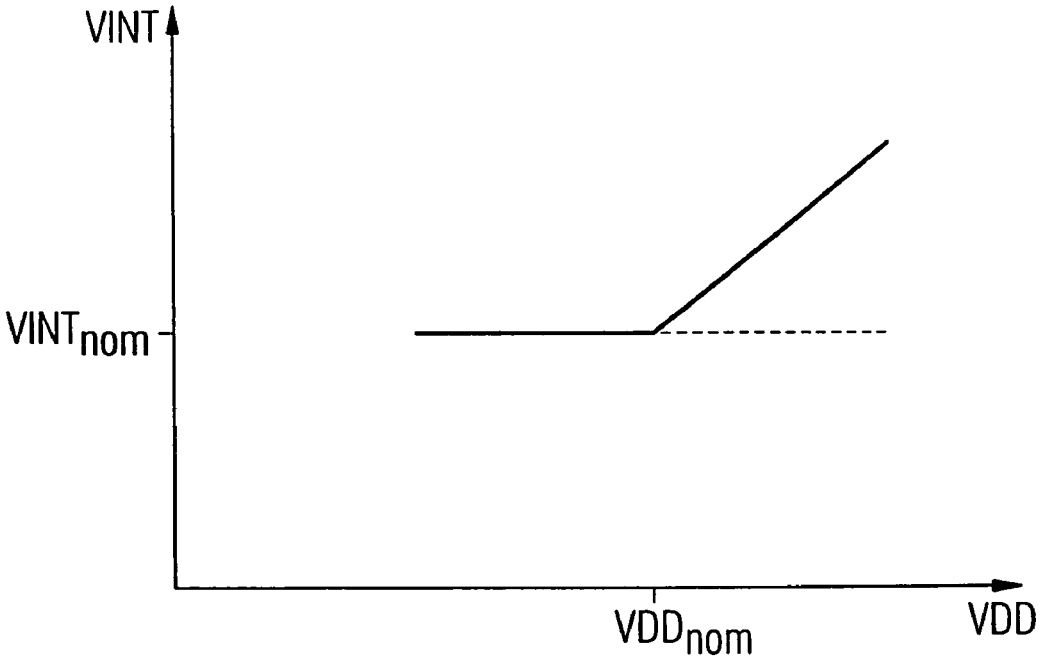
FIG. 5 illustrates a schematic representation of the level of the output voltage of the voltage regulation system shown in FIG. 2, in relation to the supply voltage level, in an activated and non-activated state of the further, additional buffer circuit.

In the activated state of the (further) buffer circuit 33 in contrast (due to the parallel connection of the two buffer circuits 13 and 33), the state of the signal input into the voltage regulator 14 at line 27 (and thereby also the state of the signal VINT emitted by the voltage regulator 14 onto line 19*c*) is in each case determined by that whichever one of the two signals VREF1 and VREF2 present on line 19*a* and 26 connected with each other and with line 27 momentarily exhibits a higher level (which ensures that—as shown in FIG. 5 by means of the solid line—the level of the signal VINT emitted by the voltage regulator 14 cannot drop below the normative and/or nominal level (VINTnom)).

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A voltage regulation system comprising:

an input of the voltage regulating system being presented with a first voltage having a first nominal value;

an output of the voltage regulation system having the first voltage changed into a second voltage having a second nominal value, which is available to be tapped at the output;

a first device for generating an essentially constant voltage from the first voltage, or a voltage derived from it, to provide the essentially constant voltage on a first line despite fluctuations of the first voltage above the first nominal value;

a further device for generating a variable further voltage from the first voltage or a voltage derived from it to provide the variable further voltage on a second line directly connected to the first line, the variable further voltage tracking the first voltage such that in response to the first voltage rising above the first nominal value, the variable further voltage rises in proportion to the first voltage; and a device for activating and/or deactivating the further device to an activated and/or deactivated state, wherein in the deactivated state, the second voltage is maintained at the second nominal value, and wherein in the activated state, the second voltage rises above the second nominal value in response to the first voltage rising above the first nominal value.

2. The voltage regulation system of claim 1, wherein the variable further voltage generated by the further device can be higher than the essentially constant voltage generated by the first device.

3. The voltage regulation system of claim 1, wherein the further device comprises a voltage divider circuit.

4. The voltage regulation system of claim 1, wherein the essentially constant voltage generated by the first device or a voltage derived from it, and the variable further voltage generated by the further device, or a voltage derived from it, can be used for controlling a voltage regulation circuit device.

5. The voltage regulation system of claim 1, wherein, in the activated state of the further device, the height of the level of a reference voltage used for a voltage regulation circuit device is determined by whichever of the essentially constant voltage generated by the first device and the variable further voltage generated by the further device exhibits the higher level.

6. The voltage regulation system of claim 1, wherein, in the deactivated state of the further device, the height of the level of a reference voltage used for a voltage regulation system circuit device is determined by the essentially constant voltage generated by the first device.

7. The voltage regulation system of claim 1, wherein the device for activating and/or deactivating the further device comprises a register.

8. A method for the regulation of voltage comprising:

changing a first voltage into a second voltage, wherein the second voltage exhibits a lower voltage level than the first voltage, the first voltage having a first nominal value and the second voltage having a second nominal value;

generating an essentially constant voltage from the first voltage, or a voltage derived from it, to provide the essentially constant voltage on a first line despite fluctuations of the first voltage above the first nominal value;

generating a variable further voltage from the first voltage or a voltage derived from it to provide the variable further voltage on a second line directly connected to the first line, the variable further voltage tracking the first voltage such that in response to the first voltage rising above the first nominal value, the variable further voltage rises in proportion to the first voltage, wherein the variable further voltage can be higher than the essentially constant voltage; and changing the essentially constant voltage to provide the second voltage having the second nominal value in a first state and changing whichever voltage is greater from among the essentially constant voltage and the variable further voltage to provide the second voltage in a second state, wherein in the second state the second voltage rises above the second nominal value in response to the first voltage rising above the first nominal value.

9. A voltage regulation system comprising:

an input having a first voltage having a first nominal value;

an output having a second voltage having a second nominal value;

a first device for generating an essentially constant voltage from the first voltage to provide the essentially constant voltage on a first line despite fluctuations of the first voltage above the first nominal value;

means for generating a tracking voltage from the first voltage that tracks the first voltage such that in response to the first voltage rising above the first nominal value, the tracking voltage rises in proportion to the first voltage;

a further device for generating a variable further voltage from the tracking voltage to provide the variable further voltage on a second line directly connected to the first line; and a device for activating and/or deactivating the further device to an activated and/or deactivated state, wherein in the deactivated state, the second voltage is maintained at the second nominal value, and wherein in the activated state, the second voltage rises above the second nominal value in response to the first voltage rising above the first nominal value.

10. The voltage regulation system of claim 9, wherein the variable further voltage can be higher than the essentially constant voltage.

11. The voltage regulation system of claim 9, further comprising a voltage divider circuit.

12. The voltage regulation system of claim 9, wherein the voltage generated by the first device and the variable further voltage can be used for controlling a voltage regulation circuit device.

13. The voltage regulation system of claim 9, wherein the essentially constant voltage and the variable further voltage can be used as a reference voltage for a voltage regulation circuit device.

14. The voltage regulation system of claim 9, wherein, in the activated state of the further device, the height of the level of a reference voltage used for a voltage regulation circuit device is determined by whichever voltage from among the essentially constant voltage and the variable further voltage exhibits the higher level.

15. The voltage regulation system of claim 9, wherein, in the deactivated state of the further device, the height of the level of a reference voltage used for a voltage regulation system circuit device is determined by the essentially constant voltage generated by the first device or the voltage derived from it.

16. The voltage regulation system of claim 9, wherein the device for activating and/or deactivating the further device comprises a register.

17. A voltage regulation system comprising:

a first reference voltage generator configured to generate an essentially constant voltage from a first voltage despite fluctuations of the first voltage above a first nominal value;

a first buffer configured to buffer the essentially constant voltage to provide a first reference voltage on a first line;

a second reference voltage generator configured to generate a tracking voltage from the first voltage, the tracking voltage tracks the first voltage such that in response to the first voltage rising above the first nominal value, the tracking voltage rises in proportion to the first voltage;

a second buffer configured to buffer the tracking voltage to provide a second reference voltage on a second line directly connected to the first line;

a device for activating and deactivating the second buffer to an activated or deactivated state; and a voltage regulator configured to provide a second voltage based on the first voltage, the first reference voltage, and the second reference voltage, wherein with the second buffer deactivated, the second voltage is maintained at a second nominal value, and wherein with the second buffer activated, the second voltage rises above the second nominal value in response to the first voltage rising above a first nominal value.

18. The voltage regulation system of claim 17, wherein the first nominal value is between 1.6 Volts and 2.0 Volts, and wherein the second nominal value is 1.5 Volts.

19. The voltage regulation system of claim 17, wherein the tracking voltage is between 0.5 and 0.95 times the first voltage.

20. The voltage regulation system of claim 17, wherein the tracking voltage is maintained above the essentially constant voltage in response to the first voltage being maintained above the first nominal value.

* * * * *